US006708012B2

(12) United States Patent
Misaizu et al.

(10) Patent No.: US 6,708,012 B2
(45) Date of Patent: Mar. 16, 2004

(54) IMAGE FORMING APPARATUS AND IMAGE FORMING METHOD

(75) Inventors: Toru Misaizu, Kanagawa (JP); Kunio Yamada, Kanagawa (JP); Makoto Hirota, Kanagawa (JP); Akira Ishii, Kanagawa (JP); Yasuki Yamauchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/385,482

(22) Filed: Mar. 12, 2003

(65) Prior Publication Data

US 2004/0033085 A1 Feb. 19, 2004

(30) Foreign Application Priority Data

Aug. 19, 2002 (JP) ..... 2002-238579

(51) Int. Cl.[7] ..... G03G 15/22; G03G 9/08
(52) U.S. Cl. ..... 399/130; 399/45; 399/53
(58) Field of Search ..... 399/130, 38, 45, 399/53, 222, 252

(56) References Cited

U.S. PATENT DOCUMENTS 4,459,344 A 7/1984 Jacob
4,871,408 A 10/1989 Honma et al.

FOREIGN PATENT DOCUMENTS

| | | |
|---|---|---|
| JP | 56-167156 | * 12/1981 |
| JP | A 2000-131875 | 5/2000 |
| JP | A 2001-194846 | 7/2001 |
| JP | 2002-99181 | * 4/2002 |
| JP | 2002-278370 | * 9/2002 |

* cited by examiner

*Primary Examiner*—Quana M. Grainger
(74) *Attorney, Agent, or Firm*—Oliff & Berridge, PLC

(57) ABSTRACT

An image forming apparatus that forms a raised print image by successively transferring foaming toner and non-foaming toner onto a recording medium in correspondence to print image information and heat-fixing onto the recording medium the foaming toner and the non-foaming toner that have been transferred onto the recording medium. The image forming apparatus includes an image processing section that image-processes the print image information so that transfer of an image resulting from the foaming toner is selectively prohibited in correspondence to a line width or size of an image to be transferred by the non-foaming toner onto the foaming toner.

17 Claims, 9 Drawing Sheets

FIG. 3

| TAG BIT | MEANING |
| --- | --- |
| 0 | NOT RAISED PRINTING (ORDINARY PRINTING) |
| 1 | RAISED PRINTING IMPLEMENTATION |

IMAGE FORMING APPARATUS AND IMAGE FORMING METHOD

BACKGROUND OF THE INVENTION

1. Field of the Invention

The present invention relates to an image forming apparatus and an image forming method with which a raised print image is formed by transferring an image resulting from foaming toner and an image resulting from non-foaming toner onto a recording medium in correspondence to print image information and utilizing thermal expansion of the foaming toner.

2. Background Art

Conventionally, technology using embossing, technology using dot impact, and technology using foam paper and heat transfer film have been known as technology that forms a raised image on a recording medium such as recording paper.

However, in the conventional technology, there are problems in terms of cost, and problems in durability and preservability. The technology is therefore only used for limited purposes.

Thus, the present applicant has proposed image forming apparatus that form a raised image using foaming toner in JP-A-2000-131875 (Title of the invention: Image Forming Toner, Method of Preparing the Image Forming Toner, and Image Forming Apparatus and Method of Forming a Raised image Using the Image Forming Toner) and in JP-A-2001-194846 (Title of the invention: Image Forming Apparatus).

The technologies disclosed in these publications make it possible to easily and inexpensively form a raised image that has excellent durability and preservability with a common electrophotographic printer or copying machine by using foaming toner.

However, these technologies cannot form a full-color raised image simply by being able to form a monochromatic raised image.

SUMMARY OF THE INVENTION

In a case where a full-color raised image is to be formed using foaming toner, the full-color raised image cannot be formed by simply superposing plural foaming toners including respectively different coloring materials and transferring the foaming toners to a recording medium. The reason for this is because it is difficult to achieve full color resulting from color layering, because the foaming toners do not have light transmittance characteristics in a foamed state.

Thus, the present applicant has proposed a structure in which a full-color raised image that has excellent durability and preservability is inexpensively formed by transferring foaming toner onto a recording medium and transferring thereon non-foaming ordinary toners of respective colors.

However, in this structure, multiple transfer, in which plural toner images are transferred, becomes necessary when the toner images are transferred to an intermediate transfer body or to the recording medium.

In particular, because color transmittance is low, it is necessary for foaming toner forming a raised print to be directly formed on a recording medium such as paper in a final print.

Accordingly, when the foaming toner is transferred to an intermediate transfer body, the foaming toner must be transferred at the very last.

When three-dimensionally printing fine lines and small regions, problems arise in that reproduced fine lines and images of small regions are partially omitted, which results in an unclear image, because transfer and fixing to the recording paper is carried out in a state in which the foaming toner is similarly disposed on fine color toner images on the intermediate transfer body.

Thus, it is an object of the present invention to provide an image forming apparatus and an image forming method with which fine lines and small regions are reproduced as a raised image with excellent quality.

In order to achieve the object the invention provides an image forming apparatus that forms a raised print image by successively transferring foaming toner and non-foaming toner onto a recording medium in correspondence to print image information and heat-fixing onto the recording medium the foaming toner and the non-foaming toner that have been transferred onto the recording medium. The image forming apparatus includes an image processing section that image-processes the print image information so that transfer of an image resulting from the foaming toner is selectively prohibited in correspondence to a line width or size of an image to be transferred by the non-foaming toner onto the foaming toner.

The invention further provides an image forming apparatus including an image processing section that image-processes the print image information so that a line width or size of an image to be transferred by the non-foaming toner onto the foaming toner is corrected in correspondence to a line width or size of an image to be transferred by the non-foaming toner onto the foaming toner.

The invention further provides an image forming apparatus including an image processing section that image-processes the print image information. The image processing section separates the print image information into a first region that mainly includes text information and a second region that mainly includes image information. The image processing section selectively transfers the foaming toner to the entity of an image in the first region or the entity of an image in the second region.

The invention further provides an image forming method, including: transferring foaming toner onto a recording medium; transferring non-foaming toner onto the recoding medium, while selectively prohibiting transfer of an image resulting from the foaming toner in correspondence to a line width or size of an image to be transferred by the non-foaming toner onto the foaming toner; and heat-fixing onto the recording medium the foaming toner and the non-foaming toner to thereby form a raised print.

The invention further provides an image forming method, including: transferring foaming toner onto a recording medium; transferring non-foaming toner onto the recoding medium, while correcting a line width or size of an image to be transferred by the non-foaming toner onto the foaming toner in correspondence to a line width or size of an image to be transferred by the non-foaming toner onto the foaming toner; and heat-fixing onto the recording medium the foaming toner and the non-foaming toner to thereby form a raised print.

The invention further provides an image forming method, including: separating an image to be transferred to a recording medium into a first region and a second region, the first region mainly including text information, the second region mainly including image information; transferring foaming toner onto the recording medium, while selectively carrying out transfer of the foaming toner with respect to the entity of an image of the first region or the entity of an image of the second region; transferring non-foaming toner onto the recoding medium; and heat-fixing onto the recording medium the foaming toner and the non-foaming toner to thereby form a raised print.

The invention further provides a recording medium, including a medium body; and a raised print image formed on the medium body. The raised print image includes a first layer and a second layer. The second layer is superimposed on the first layer. The first layer is made from forming toner. The second layer is made from non-forming toner and is divided into a plurality of regions each forms small images smaller in size than the entity of the raised print image. Line widths or sizes of the small images are smaller than a predetermined line width or size. The plurality of regions are formed on at least a portion of the first layer formed successively on the medium body.

BRIEF DESCRIPTION OF THE DRAWINGS

The present invention may be more readily described with reference the accompanying drawings:

FIG. 3 is a data image in a case where image information is described per region of text, images, and graphics as PDL (Page Description Language).

DETAILED DESCRIPTION OF THE PREFERRED EMBODIMENTS

Embodiments for implementing raised printing that provide an image forming apparatus and an image forming method pertaining to the present invention will be described in detail below with reference to the attached drawings.

Figure 1:
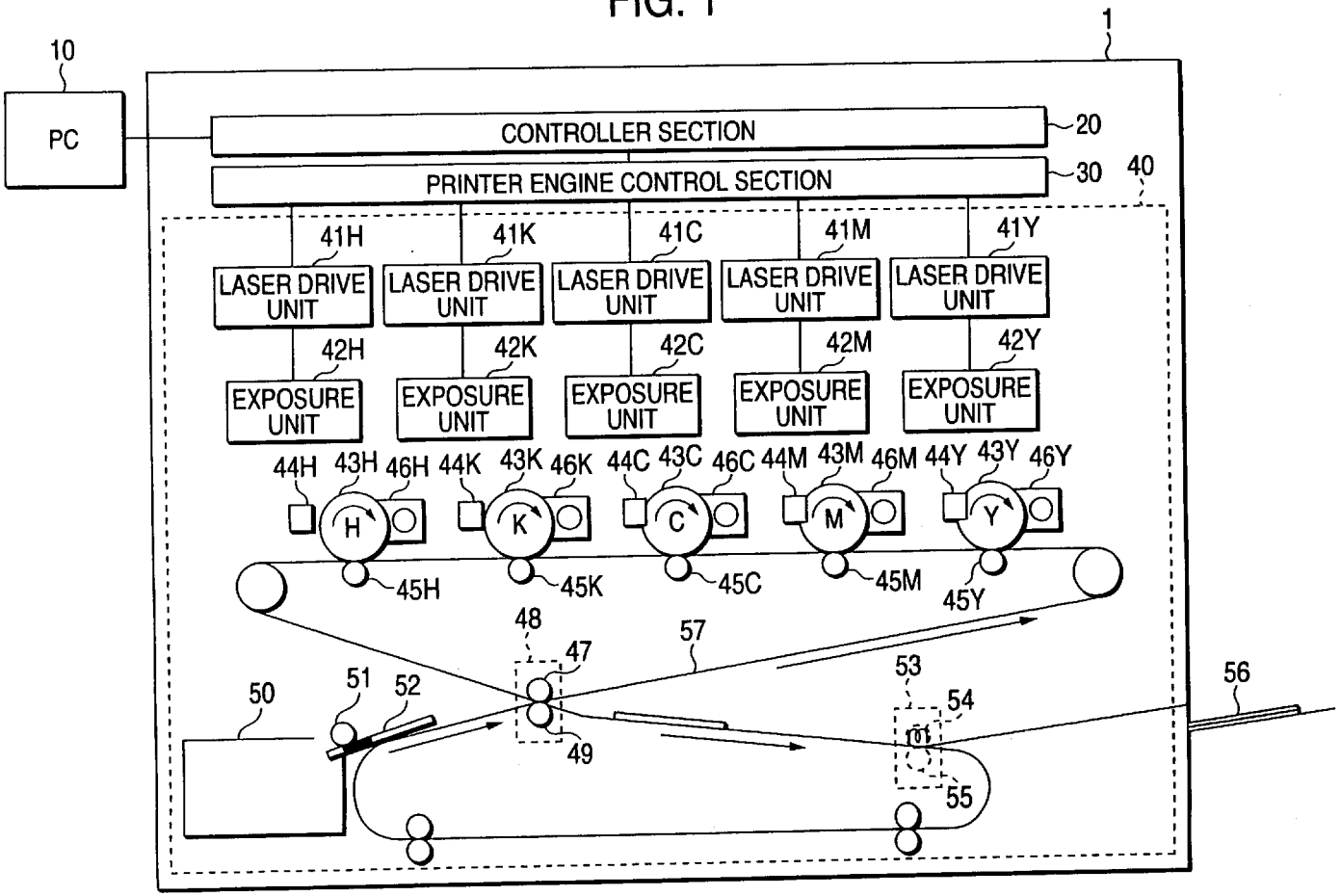
FIG. 1 is a view illustrating the internal structure of an image forming apparatus in the invention.

FIG. 1 is a view illustrating the internal structure of an image forming apparatus 1.

The image forming apparatus 1 is structured by a controller section 20, a printer engine control section 30, and an image forming section (IOT) 40. The controller section 20 receives user-designated information relating to raised printing and color information such as sRGB and image information created and edited by a PC (Personal Computer) 10 or the like, creates image data for printing from the information per image class (text, graphic, image), and carries out color conversion processing, color correction processing, and raised printing discrimination processing per pixel.

The printer engine control section 30 converts yellow (Y), magenta (M), cyan (C), and black (K) information (each being 8 bits) received per pixel and height (H) information (each being 8 bits), which has been converted and calculated from the color information or directly designated by user information, to a pulse signal that controls laser light carrying out image exposure at the image forming section 40 and sends the pulse signal.

The image forming section 40 is mainly structured by: laser drive units 41Y to 41H that scan-expose laser light; exposure units 42Y to 42H that emit laser light to photosensitive drums 43Y to 43H; the photosensitive drums 43Y to 43H that form electrostatic latent images; charge units 44Y to 44H that charge the photosensitive drums 43Y to 43H to a predetermined potential; developing units 46Y to 46H that form toner images on the photosensitive drums 43Y to 43H; primary transfer rolls 45Y to 45H for intermediately transferring the toner images formed on the photosensitive drums; a secondary transfer unit 48; and a fixing unit 53.

The steps by which a raised color image is formed are carried out in the following order.

The laser drive units 41Y to 41H scan-expose laser light using a pulse signal modulated in accordance with a color gradation number of image data and emit the laser light toward the photosensitive drums 43Y to 43H using the exposure units 41Y to 41H.

The photosensitive drums 43Y to 43H are rotatingly driven along the directions of the arrows at a predetermined speed. After surfaces of the photosensitive drums 43Y to 43H have been pre-charged to a predetermined polarity (e.g., a negative polarity) and potential by the charge units 44Y to 44H, electrostatic latent images are formed thereon by the laser light being scan-exposed.

With respect to the electrostatic latent images formed on the photosensitive drums 43Y to 43H, toner images are respectively formed by the developing units 46Y to 46H that develop the foaming toner (H) and the four colors of yellow (Y), magenta (M), cyan (C), and black (K).

Additionally, the toner images formed on the photosensitive drums 43Y to 43H are multiply transferred to an intermediate transfer belt 57 by the primary transfer rolls 45Y to 45H.

All or part of the toner images of yellow (Y), magenta (M), cyan (C), black (K), and of a height (H) are transferred, in a state in which they have been successively superposed by the primary transfer rolls 45Y to 45H, onto the intermediate transfer belt 57 in correspondence to the height and colors of the image to be formed.

The toner images that have been multiply transferred onto the intermediate transfer belt 57 are conveyed at a predetermined timing to the secondary transfer unit 48 and transferred to a raised image recording paper 52, which is supplied by a feed roller 51 from a paper supply tray 50 disposed at a lower part of the image forming apparatus 1, by a pressure contact force and an electrostatic suction force of a backup roll 47 that supports the intermediate transfer belt 57 and a secondary transfer roll 49 that contacts the backup roll 47.

After the raised image recording paper 52 to which the toner images have been transferred has been separated from the intermediate transfer belt 57, it is conveyed to the fixing unit 53, where the toner images are fixed onto the raised image recording paper 52 by a heat roll 54 and a pressure roll 55 of the fixing unit 53, and then discharged to a stacker 56 of the image forming apparatus 1, whereby the steps by which the raised color image is formed conclude.

Figure 2:
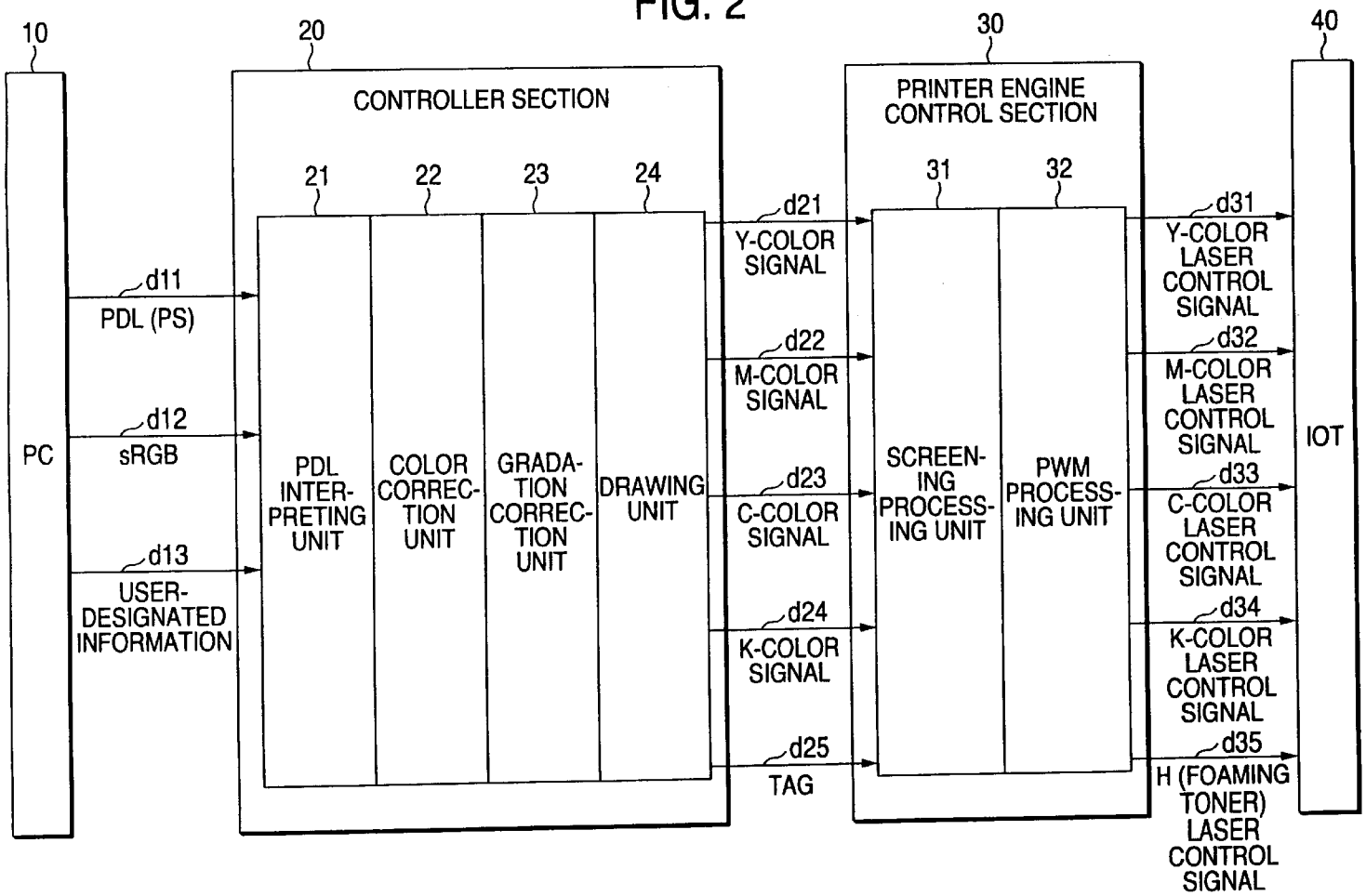
FIG. 2 is a view illustrating functional blocks of a controller section, a printer engine control section, and an IOT (image forming section), and signals that are inputted and outputted between the respective blocks.

Next, functional blocks of the controller section 20 and the printer engine control section 30 of FIG. 1, and data that is inputted and outputted between the processing blocks, are illustrated in FIG. 2 and will be described.

The controller section 20 is separated into the respective processing blocks of a PDL interpreting unit 21, a color correction unit 22, a gradation correction unit 23, and a drawing unit 24. The printer engine control section 30 is separated into the respective processing blocks of a screening processing unit 31 and a PWM (Pulse Width Modulation) processing unit 32.

The controller section 20 receives: PDL (Page Description Language) d11 that describes, per page unit, image information for raised printing that has been created and edited at the PC 10; an sRGB signal d12 as color information; and user-designated information dl3 necessary for raised print processing.

Figure 4:
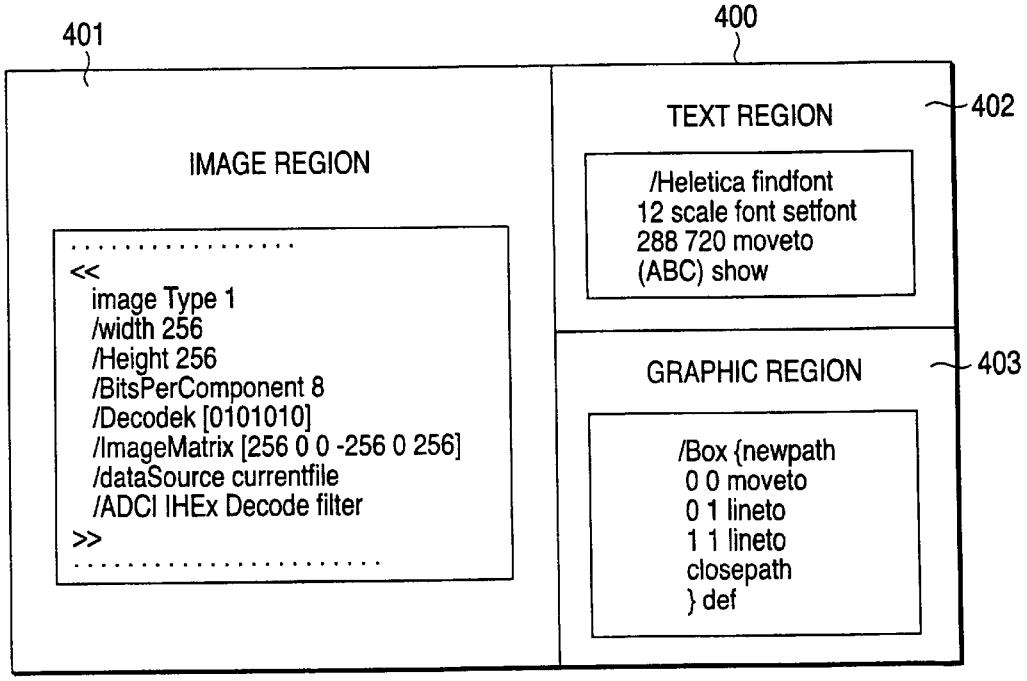
FIG. 4 is a view illustrating the content of Tag information for discriminating, at a pixel unit, whether raised printing is to be implemented or not (ordinary printing).

A data image of the PDL d11 is one in which, as in image information 400 of FIG. 4, drawing content is described by classifying a target image for raised printing into image classes, which are an image region 401, a text region 402, and a graphic region 403.

In a case where the target image is the image region 401, information of an image file and the height and width of the region are described.

In a case where the target image is the text region 402, information of character lines and the size and type of the file are described.

In a case where the target image is the graphic region 403, information relating to the size, source, and type of figure to be drawn is described.

Information relating to the colors of the raised image is set in the sRGB signal d12.

The user-designated information d13 includes the target region for raised print processing and setting items necessary for raised printing.

The PDL interpreting unit 21 interprets the descriptions per image class, and extracts the drawing target region per image class and drawing information such as size in the case of text and graphics.

Next, the color conversion unit 22 is once converted from the sRGB signal to a LAB color space.

The gradation correction unit 23 uses individual conversion tables, to which consideration of gradation characteristics of the printer engine control unit 30 has been given, and converts the colors of the image information expressed at the LAB color space to YMCK.

The drawing unit 24 carries out image conversion to a raster image using, as a basis, the drawing information extracted at the PDL interpreting unit 21 and the color information processed by the color conversion unit 22 and the gradation correction unit 23.

At this time, the raised printing target/non-target per pixel is discriminated by "processing for discriminating raised printing target regions" (the details of which will be described later) using, as a basis, the user-designated information d13 received from the PC 10 and the drawing information extracted at the PDL interpreting unit 21.

The discrimination results are set per pixel to Tag information.

FIG. 3 is a view illustrating the content of Tag information 301, which is expressed as a variable of 1 bit.

When the definition of the setting value is 0, the region is not a raised printing target (ordinary printing), and when the value is 1, the region is a raised printing target.

The screening processing unit 31 adjusts a constant density level per pixel of the raster image created at the drawing unit 24, and is configured so that the light and shade of the image can be expressed on a printed matter.

The PWM processing unit 32 creates, in correspondence to pixel order, a pulse signal by referencing conversion tables for converting, to a laser irradiation amount, the YMCK color information that has been screening-processed at the screening processing unit 31, creates a Y-color laser control signal d31, an M-color laser control signal d32, a C-color laser control signal d33, and a K-color laser control signal d34, and outputs these to the IOT 40.

A foaming toner laser control signal d35 is also outputted to the IOT 40 by converting, to a pulse signal, the YMCK color information adjusted at the screening processing unit 31 and a height calculated on the basis of the Tag information d25.

Next, three correction modes for reproducing, with excellent image quality, fine lines and small regions in three-dimensional print processing will be described.

The first correction mode is a mode that selectively processes raised prints and ordinary prints using a set reference value as a border. A print image in this case is illustrated in FIG. 5.

Figure 5:
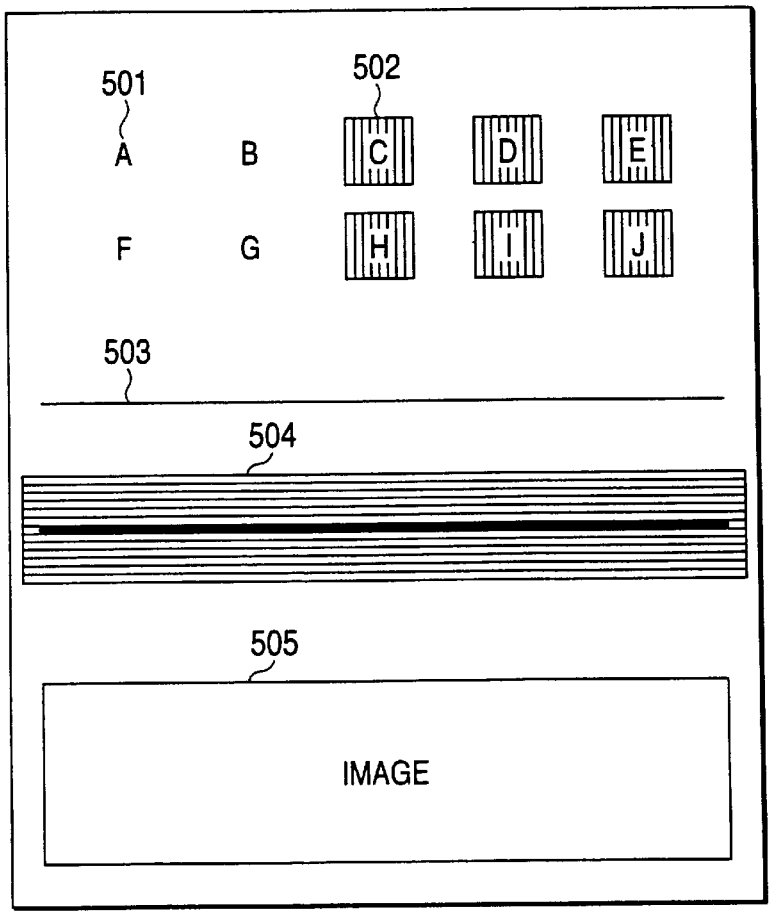
FIG. 5 is an image view of a print image when ordinary printing and raised printing have been selectively processed using as a boundary a set reference value.

Lines and text enclosed by hatched frames in FIG. 5 represent raised printing targets. Texts (4P) 501, whose size is 4 point, and texts (8P) 502, whose size is 8 point, are the text regions of the respective regions of the original image.

There are also a line (4P) 503, whose size is 4 point, and a line (8P) 504, whose size is 8 point, which are straight lines drawn as graphic regions.

Raised printing is set with regard to all of the text, image, and graphic image classes, and in a case where a border value discriminating raised printing and standard printing is set to "4P", "Tag=0 (ordinary printing)" is set for the text (4P) 501 regions and "Tag=1 (raised printing)" is set for the text (8P) 502 regions in processing to discriminate regions for which raised printing is to be implemented.

Similarly, for the straight lines drawn as graphic regions, "Tag=0 (ordinary printing)" is set for the line (4P) 503 region, whose size is 4 point, and "Tag=1 (raised printing)" is set for the line (8P) 504 region, whose size is 8 point.

The second correction mode is a mode that three-dimensionally prints the fine lines and small image regions by raising them to a size of a constant reference value. A print image in this case is illustrated in FIG. 6.

Figure 6:
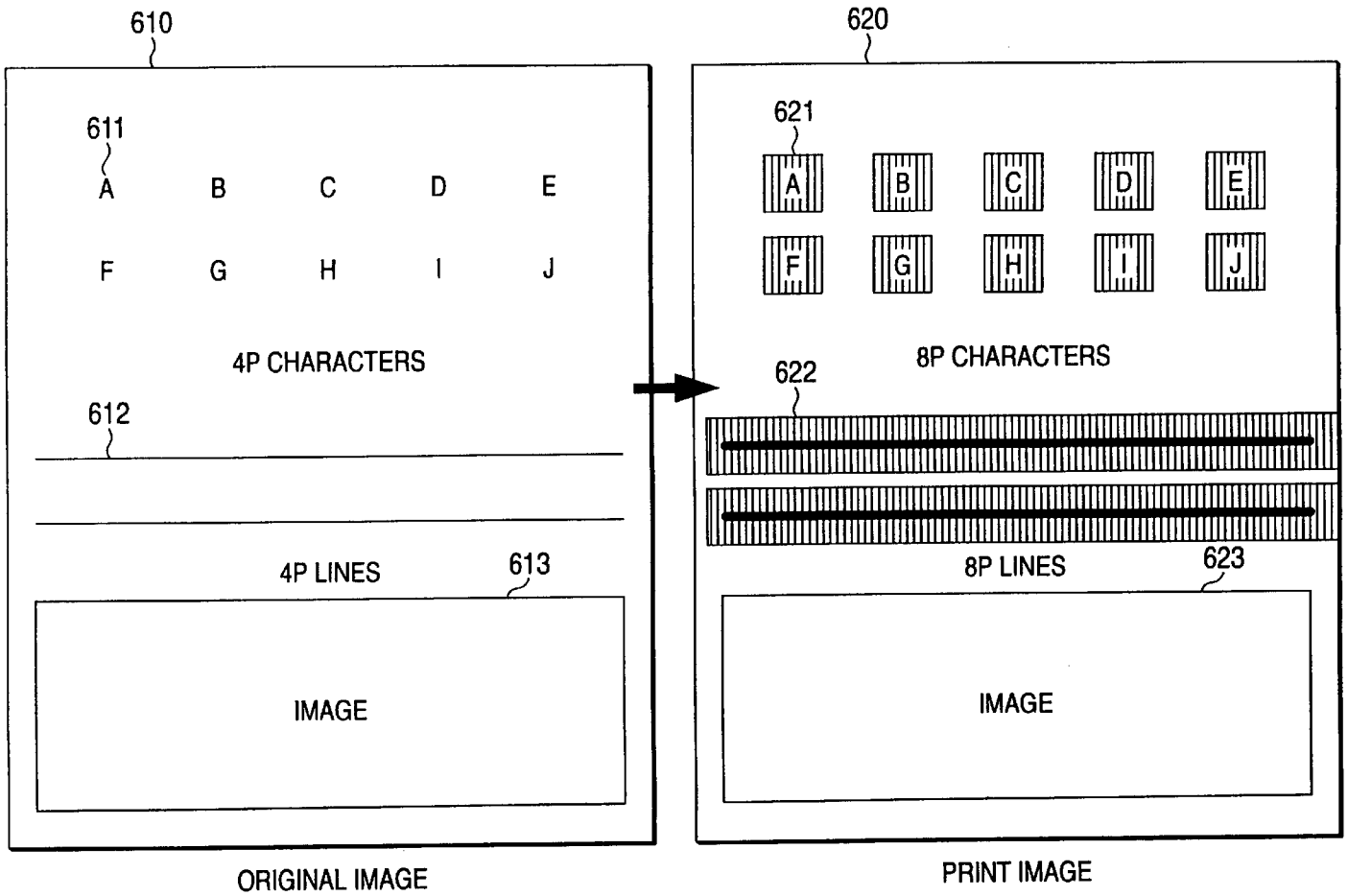
FIG. 6 is an image view of an original image and a print image when fine lines and a small image region have been raised to a size of a constant reference value and raise-printed.

Lines and text enclosed by hatched frames in FIG. 6 represent the fact that they are to be raise-printed.

In an original image 610, texts (4P) 611, whose sizes are all 4 point, are the text regions, and lines (4P) 612, whose sizes are 4 point, are drawn as graphic regions.

The raised print processing here is designated with regard to all texts, images, and graphics, and in a case where the designated value of raised printing implementation is "4P", when there is a setting to fatten to "8P" and raise-print, the designated sizes of the graphic regions and text regions of the image information are enlarged to "8P", and "Tag=1 (raised printing)" is set for the regions of the lines (8P) 622 and the texts (8P) 621 of a print image 620.

Figure 7:
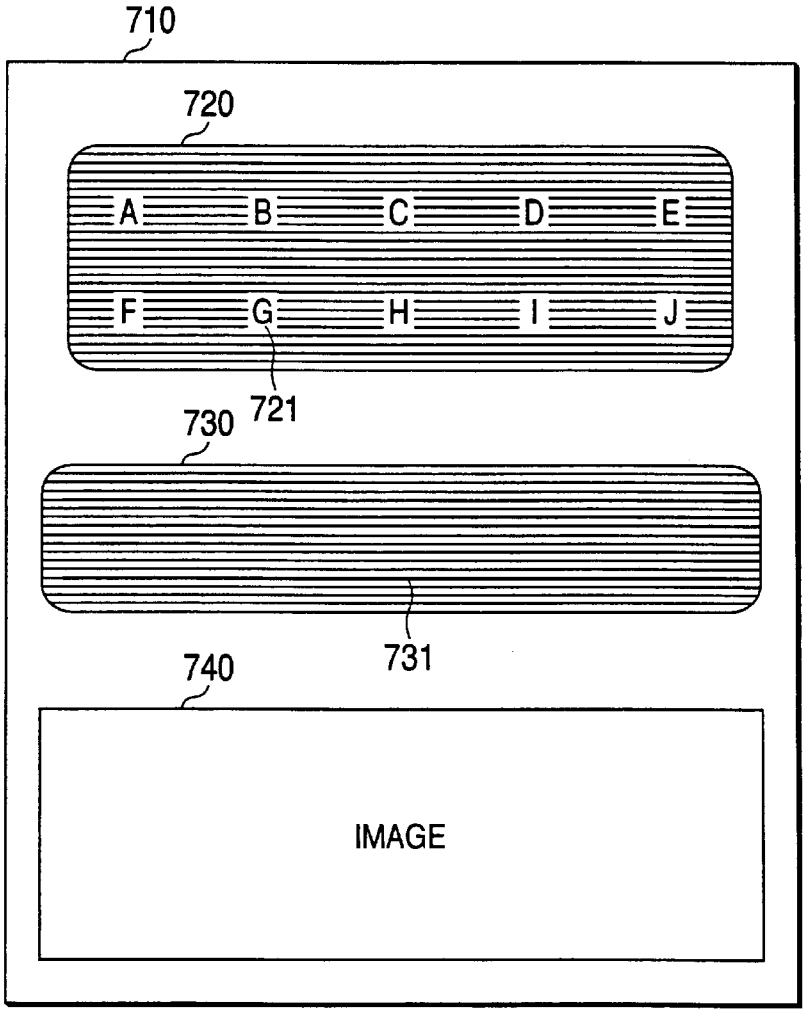
FIG. 7 is an image view of an image in which a macro region including fine lines and a small image region has been three-dimensionally printed.

Next, the third correction mode is a mode that raise-prints an entire region (hereinafter called a"macro region") including fine lines and small image regions. A print image in this case is illustrated in FIG. 7.

An image region 710 is structured by a text region 720, a graphic region 730, and an image region 740, and the sizes of the text region 720 and the graphic region 730 are set at "4P".

In a case where the sizes of the text region and the graphic region designated as for raised printing are equal to or less than the constant reference value, a macro region including the text and lines is raise-printed in place of raise-printing only the regions of the lines and text.

By doing so, with respect to text 721 (4P) and a line 731 (4P), an image is formed at an image drawn on a hill of the region 730 and the region 720 formed by raised printing.

Figure 8:
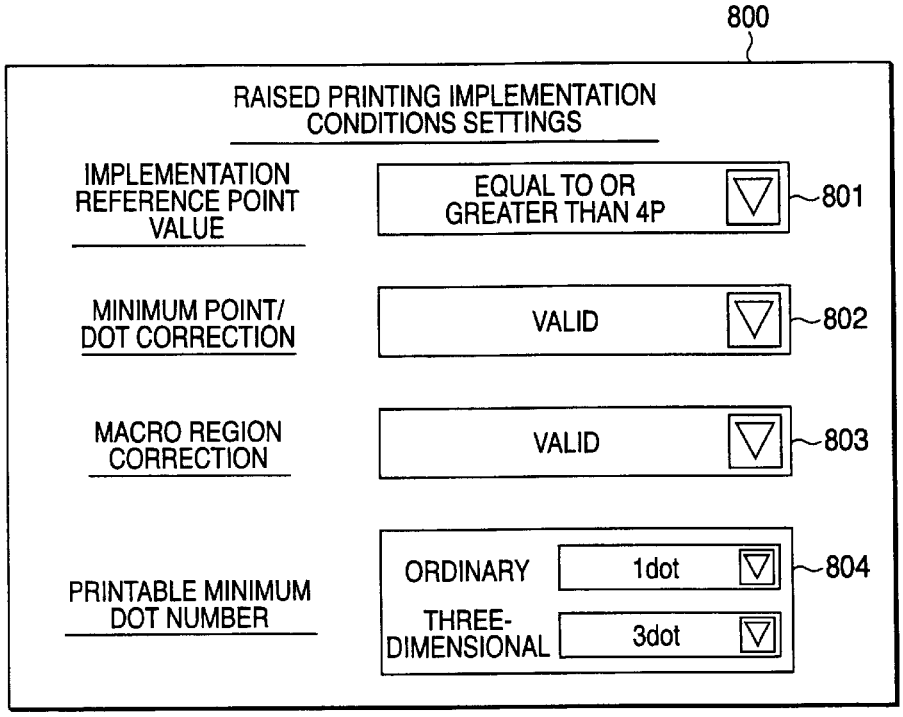
FIG. 8 is a user interface for setting conditions for implementing raised printing.
Figure 9:
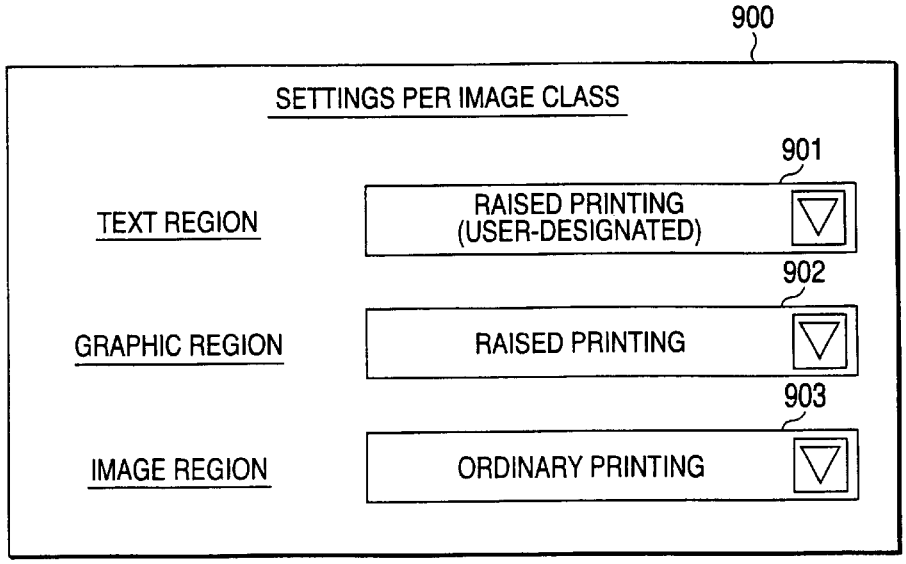
FIG. 9 is a user interface for setting raised printing/ordinary printing per type of image region.

Examples of setting items requiring user designation and examples of user interfaces therefor when the correction modes of FIGS. 5 to 7 described thus far are to be implemented are illustrated in FIGS. 8 and 9 and will be described.

A user interface 800 of FIG. 8 is a user interface that sets detailed implementation conditions when raised printing is to be implemented.

In the user-designated items, there are an implementation reference point value 801, minimum point/dot correction 802, macro region correction 803, and a printable minimum dot number 804.

The implementation reference point value 801 is a reference value when the determination of raised printing/ordinary printing is decided by the size of the lines and text.

The minimum point/dot correction 802 is an item that designates validity/invalidity of processing that carries out raised printing at a size that has been raised to the reference value in regard to a region in which the size of the lines and text of a raised printing target region falls below the reference value.

The macro region correction 803 is an item that selects validity/invalidity of correction processing that raise-prints a macro region including lines and text when the size of lines and text designated for raised printing falls below the implementation reference value and maintains the size of the lines and text.

The printable minimum dot number 804 is an item that designates an implementable minimum dot number in regard to ordinary printing and raised printing.

A user interface 900 of FIG. 9 is a user interface for separately designating raised printing/ordinary printing per image class (text, graphic, image) of image information.

Next, the processing order of the "processing for discriminating raised printing target regions" that discriminates targets/non-targets for raised printing at a pixel unit is illustrated in the flow chart of FIG. 10 and will be described using, as a basis, the modes illustrated thus far in FIGS. 5, 6, and 7 and setting conditions resulting from the user interfaces illustrated in FIGS. 8 and 9.

The image information described by the PDL is analyzed, and the user-designated information relating to raised printing and drawing regions per image class are obtained (Step S101).

Next, at the user interface of FIG. 9, it is determined whether the image class that the user has designated for raised printing is present in the image data (Step S102).

When regions of the image class that the user has designated for raised printing are not in the image information (proceed to NO at Step S102), "Tag=0 (standard printing)" is set for information of each pixel of the printing target region (Step S106).

When there is an image class that has been designated for raised printing (proceed to YES at Step S102), "Tag=1 (raised printing)" is set for the information of each pixel of the target region when the designated size of the target region is larger than standard point (Step S109).

When the target region is equal to or less than the reference value (YES at Step S103), it is determined whether size correction is to be rendered valid or invalid by the minimum point/dot correction 802 of the user interface 800 of FIG. 8.

When size correction of the region is rendered valid (proceed to YES at Step S104), the target region is enlarged to a size designated by the implementation reference point value 901 of the user interface 900 of FIG. 9, and "Tag=1 (raised printing)" is set for the information of each pixel of the target region (Step S108).

When designation of size correction of the drawing region is invalid (proceed to NO at Step S105), the macro region correction 803 of the user interface 800 of FIG. 8 determines whether or not it has been designated by the user.

When the macro region correction is valid (proceed to YES at Step S105), "Tag=1 (raised printing)" is set for all pixel information in order to three-dimensionally print, as a single macro region, the entire image region equal to or less than the reference size of the text and graphic regions (Step S107).

When the macro region correction is invalid (proceed to NO at Step S105), "Tag=0 (standard printing)" is set for the information of each pixel of the target region.

The above is an example in which the three modes illustrated in FIGS. 5, 6, and 7 for reproducing fine lines with excellent quality are discriminated and processed according to setting conditions by a single processing program.

Figure 10:
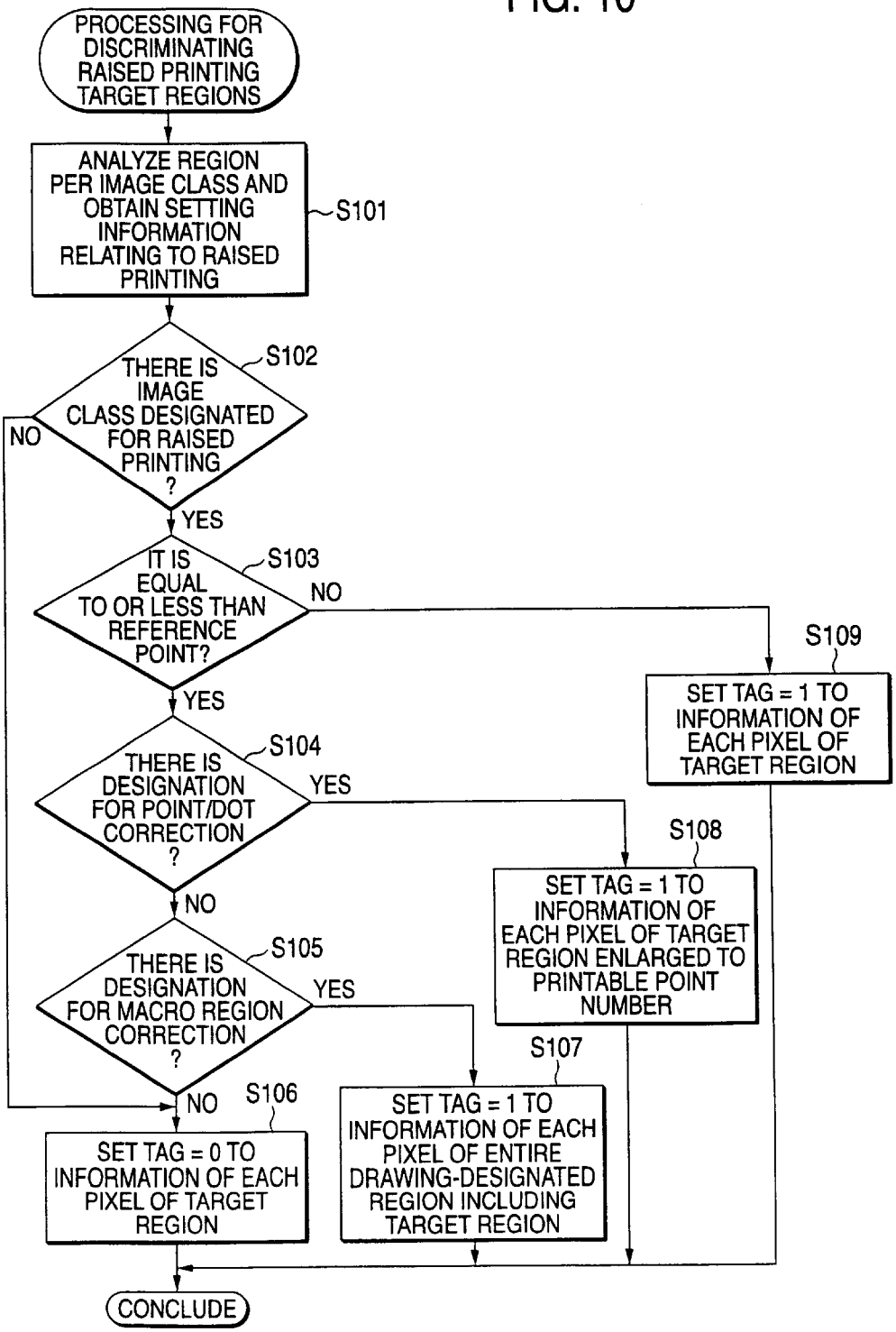
FIG. 10 is a flow chart of raised printing implementation region discrimination processing.

In the case of the processing flow illustrated in FIG. 10, description was given with the assumption that setting processing is concluded by the user interfaces of FIGS. 8 and 9 before the "processing for discriminating raised printing target regions". However, in Step S102, Step S103, Step S104, and Step S105, the determination conditions may be configured to an inquiry format by the user interface, and processing may be configured to processing in which alterations and input of setting values by the user are possible in the middle of the processing.

Additionally, the processing order of the determination processing of Step S104 and Step S105 may be reversed, and a mode that carries out correction processing of both Step S108 and Step S109 may also be added.

Moreover, the correction modes of FIGS. 5 to 7 may be selectable at the user interfaces and configured as processing modes that determine the correction mode at a higher step of processing of FIG. 10.

As described above, according to the invention, when fine lines and small regions have been designated for raised printing, correction processing of raised printing is carried out using, as a basis, setting information per region class that a user has designated in advance, and is it possible to reproduce, with excellent quality, the fine lines and small regions.

What is claimed is:

1. An image forming apparatus that forms a raised print image by successively transferring foaming toner and non-foaming toner onto a recording medium in correspondence to print image information and heat-fixing onto the recording medium the foaming toner and the non-foaming toner that have been transferred onto the recording medium, the image forming apparatus comprising:

an image processing section that image-processes the print image information so that transfer of an image resulting from the foaming toner is selectively prohibited in correspondence to a line width or size of an image to be transferred by the non-foaming toner onto the foaming toner.

2. The image forming apparatus as claimed in claim 1, wherein the print image information includes control information representing an image for which transfer is to be carried out using the foaming toner; and the image processing section selectively deletes the control information in correspondence to the line width or size of the image to be transferred by the non-foaming toner onto the foaming toner.

3. An image forming apparatus that forms a raised print image by successively transferring foaming toner and non-foaming toner onto a recording medium in correspondence to print image information and heat-fixing onto the recording medium the foaming toner and the non-foaming toner that have been transferred onto the recording medium, the image forming apparatus comprising:

an image processing section that image-processes the print image information so that a line width or size of an image to be transferred by the non-foaming toner onto the foaming toner is corrected in correspondence to a line width or size of an image to be transferred by the non-foaming toner onto the foaming toner.

4. The image forming apparatus as claimed in claim 3, wherein the image processing section corrects the line width or size of the image to a large value at a predetermined ratio in a case where the line width or size of the image to be transferred by the non-foaming toner onto the foaming toner is less than a predetermined line width or size.

5. The image forming apparatus as claimed in claim 3, wherein the image processing section corrects the line width or size of the image to a small value at a predetermined ratio in a case where the line width or size of the image to be transferred by the non-foaming toner onto the foaming toner is less than a predetermined line width or size.

6. An image forming apparatus that forms a raised print image by successively transferring foaming toner and non-foaming toner onto a recording medium in correspondence to print image information and heat-fixing onto the recording medium the foaming toner and the non-foaming toner that have been transferred onto the recording medium, the image forming apparatus comprising:

an image processing section that image-processes the print image information;

wherein the image processing section separates the print image information into a first region that mainly includes text information and a second region that mainly includes image information; and the image processing section selectively transfers the foaming toner to the entity of an image in the first region or the entity of an image in the second region.

7. The image forming apparatus as claimed in claim 6, wherein the image processing section transfers the foaming toner to the first region.

8. The image forming apparatus as claimed in claim 6, wherein the image processing section transfers the foaming toner to the second region.

9. An image forming method, comprising:

transferring foaming toner onto a recording medium;

transferring non-foaming toner onto the recoding medium, while selectively prohibiting transfer of an image resulting from the foaming toner in correspondence to a line width or size of an image to be transferred by the non-foaming toner onto the foaming toner; and heat-fixing onto the recording medium the foaming toner and the non-foaming toner to thereby form a raised print.

10. An image forming method, comprising:

transferring foaming toner onto a recording medium;

transferring non-foaming toner onto the recoding medium, while correcting a line width or size of an image to be transferred by the non-foaming toner onto the foaming toner in correspondence to a line width or size of an image to be transferred by the non-foaming toner onto the foaming toner; and heat-fixing onto the recording medium the foaming toner and the non-foaming toner to thereby form a raised print.

11. The image forming method as claimed in claim 10, wherein the line width or size of the image is corrected to a large value at a predetermined ratio in a case where the line width or size of the image to be transferred by the non-foaming toner onto the foaming toner is less than a predetermined line width or size.

12. The image forming method as claimed in claim 10, wherein the line width or size of the image is corrected to a small value at a predetermined ratio in a case where the line width or size of the image to be transferred by the non-foaming toner onto the foaming toner is less than a predetermined line width or size.

13. An image forming method, comprising:

separating an image to be transferred to a recording medium into a first region and a second region, the first region mainly including text information, the second region mainly including image information;

transferring foaming toner onto the recording medium, while selectively carrying out transfer of the foaming toner with respect to the entity of an image of the first region or the entity of an image of the second region;

transferring non-foaming toner onto the recoding medium; and heat-fixing onto the recording medium the foaming toner and the non-foaming toner to thereby form a raised print.

14. The image forming method as claimed in claim 13, wherein transfer using the foaming toner is selectively carried out with respect to the first region.

15. The image forming method as claimed in claim 13, wherein transfer using the foaming toner is selectively carried out with respect to the second region.

16. A recording medium, comprising:

a medium body; and a raised print image formed on the medium body;

wherein the raised print image includes a first layer and a second layer, the second layer superimposed on the first layer;

the first layer is made from forming toner;

the second layer is made from non-forming toner and is divided into a plurality of regions each forms small images smaller in size than the entity of the raised print image;

line widths or sizes of the small images are smaller than a predetermined line width or size; and the plurality of regions are formed on at least a portion of the first layer formed successively on the medium body.

17. The recording medium as claimed in claim 16, wherein the second layer further includes a region forming a large image having a line width or size larger than the predetermined line width or size; and the large image is accompanied with a portion of the first layer formed traceably beneath the large image.

* * * * *